US005510779A

United States Patent [19]

Maltby et al.

[11] Patent Number: 5,510,779

[45] Date of Patent: Apr. 23, 1996

[54] ERROR COMPENSATING INSTRUMENT SYSTEM WITH DIGITAL COMMUNICATIONS

[75] Inventors: Frederick L. Maltby, Jenkintown; L. Jonathan Kramer, Warminster; Leslie D. Horrocks, deceased, late of North Hills; by Maureen Horrocks, executrix, North Wales; David M. Stern, Merion Station, all of Pa.

[73] Assignee: Drexelbrook Controls, Inc., Horsham, Pa.

[21] Appl. No.: 72,608

[22] Filed: Jun. 4, 1993

[51] Int. Cl.[6] ..... G08C 19/00

[52] U.S. Cl. ..... 340/870.300; 340/870.04; 340/870.05; 340/870.16; 324/669

[58] Field of Search ..... 340/870.04, 870.05, 340/870.16, 870.17, 870.18, 870.21, 870.3, 870.4; 364/571.02, 571.03, 571.05, 571.06; 324/669, 684

[56] References Cited

U.S. PATENT DOCUMENTS 4,468,610 8/1984 Hanson ..... 324/669
4,783,659 11/1988 Frick ..... 340/870.04

*Primary Examiner*—John K. Peng
*Assistant Examiner*—Andrew Hill

[57] ABSTRACT

An instrument system provides compensation for signal processing errors by processing both sensor signals and reference signals in a common signal processor. Reference signals may be provided which enable zero compensation, gain compensation, or both. The system outputs compensated signals to a two wire signal loop in either analog or digital form, and selects the form of output signal in accordance with digital input signals received from the signal wires. The system may be embodied as a radio frequency admittance instrument system for monitoring the condition of materials.

22 Claims, 11 Drawing Sheets

TO FIG. 2B
138
+2π
140
214
164
136
134
CHOPPER
168
144
132
X36
A
190
+6VDC
BRIDGE CONTROLLER
SHD
154
SWITCH
172
166
148
126
LEV
SHD
REF
CW
146
+6V SUPPLY
128
SPAN
122
PROBE
REF
160
158
174
-0.6VDC
-0.6V SUPPLY
156
SHD
PAD
17t
3t
120
SHD
116
3t
118
GROUND
17t
-3.5VDC
+9.6VDC
150
CHOPPER DRIVE
+9.6VDC
114
OSCILLATOR
112
192
-3.5V SUPPLY

ERROR COMPENSATING INSTRUMENT SYSTEM WITH DIGITAL COMMUNICATIONS

FIELD AND BACKGROUND OF THE INVENTION

This invention relates to instrument systems, such as are used for measurement and control of industrial processes. More particularly, this invention relates to compensation of errors in electronic instrument systems in which a physical variable (such as the level of material in a vessel) is converted by a sensor (sometimes referred to as a "probe") to an electrical signal (such as a capacitance, admittance, or a current which is related thereto) which is presented as an input to an instrument system. Still more particularly, this invention relates to compensation for errors which may arise in such systems, by selectively coupling different inputs to a common signal processor, and providing a compensated output based on the responses of the signal processor to the different inputs. This invention also relates to systems for communicating an output, such as the compensated output, to a remote location and receiving instrument instructions from a remote location.

Instrument systems are subject to errors arising from a number of sources. An example of such an instrument system is a radio frequency admittance responsive system, for instance as shown in U.S. Pat. No. 1,416,834. Such a system may be used to measure the level of materials in a vessel; a vertically disposed sensor provides an admittance which is a function of material level, and an admittance-responsive instrument coupled to the sensor provides an output which is a function of the sensor admittance. Errors, i.e. deviation of the instrument output from the value corresponding exactly to the physical variable sought to be measured, can arise from a number of sources. One source is the transfer function of the sensor itself. For instance, the output of a vertically disposed sensor admittance may be a function of material electrical properties (e.g. dielectric constant) as well as the material level. In the past, such errors have been compensated by providing an additional separate instrument system which responds to material electrical properties but not to material level, and using the output of the separate instrument system as a reference to compensate the primary instrument output for changes in material properties. See, e.g., U.S. Pat. No. 4,232,300. Such systems are generally expensive and complicated.

Another source of error in such systems is the transfer function of the instrument. The transfer function may change for instance due to aging of components, environmental influences such as changes in temperature of components, or changes in measuring conditions such as instrument loading. Such errors may appear as offset or "zero" errors, which are independent of the measured value, and/or gain or "span" errors which are a function of the measured value. In the past, such error sources have typically been addressed by "brute force" methods such as use of stable precision components and circuit designs in which the effects of environmental and measuring conditions on circuit operation are minimized. Systems employing such methods are also generally expensive and complicated.

The foregoing problems, and the drawbacks of prior art attempts to address them, tend to be particularly acute in radio frequency admittance monitoring systems, especially loop powered or "two-wire" instrument systems where the operating power for the instrument system is severely limited. For instance, radio frequency admittance monitoring systems are generally required to have high isolation between their sensor admittance-measuring circuitry and their output circuitry in order to prevent an explosion hazard resulting from introduction of high energy electrical potentials into a flammable atmosphere which may surround the sensor. The complexity and expense of providing precision measurements by brute force methods while also providing such isolation are substantial, particularly in systems which process signals from several sensors.

In radio frequency admittance monitoring instruments of the "two wire" type, i.e. in which the instrument receives its operating power from and transmits its output signal to a single pair of signal wires connecting the instrument to a remote location, improving precision of measurement is particularly problematic because of the constraints on power available to the instrument. Two wire instruments are generally required to provide an output signal in the range of 4–20 mA, which means that the instrument must operate under worst-case conditions on a current budget of less than 4 mA. With as little as 10 V available from the signal wires at the instrument, this requires the instrument to be able to operate with a power less than 40 mW. To improve the precision of measurement in such an environment by conventional means generally requires use of more power; for instance, the amplitude stability of an RF oscillator and the gain stability of an RF amplifier generally degrade rapidly with decreasing power.

Radio frequency two-wire admittance monitoring systems have heretofore been limited in their modes of communication with equipment in a remote location. They have generally provided an analog output signalling current varying from 4 mA to 20 mA in response to changes in the measured admittance; some have provided a digital output signal in a limited nonstandard format. They have also been limited in their ability to receive signals, such as signals representing instructions to the instrument, from the signal wires.

SUMMARY OF THE INVENTION

It is therefore a general object of the invention to provide a method and apparatus ("system") for compensating measuring errors which avoids or minimizes the aforementioned drawbacks of the prior art.

It is also an object of the invention to provide an error compensating system which is simple, reliable, effective, and inexpensive.

It is also an object of the invention to provide a radio frequency admittance monitoring instrument system utilizing such an error compensating system.

It is also an object of the invention to provide a two-wire instrument system utilizing such an error compensating system.

It is another object of the invention to provide a two-wire radio frequency admittance monitoring system which is capable of receiving digital input signals from its signal wires and transmitting output signals to its signal wires in digital and/or analog form.

It is a further object of the invention to provide an instrument system according to the foregoing objects which provides a high degree of isolation between circuitry coupled to a sensor and circuitry coupled to the instrument power supply and output.

In accordance with a first aspect of the invention the instrument system of the invention includes: a signal processor, having an input adapted to receive a sensor signal which is a function of a physical variable to be measured and producing a processor output signal which is a function of the processor input signal; a switch, which selectively couples the signal processor input to the sensor signal and to at least one reference signal; and a compensated output signal generator (hereinafter "compensator") having a compensator input coupled to the processor output to receive processor signals occurring when the switch couples the processor input to the sensor signal and to the reference signal(s). Preferably, the compensator and the switch operate under common control so that they are synchronized. In a particularly preferred embodiment, the instrument system is a guarded two-wire radio frequency admittance monitoring system.

In accordance with another aspect of the invention, a two wire admittance responsive instrument system includes input means coupled to its signal wires for receiving digital signals from the signal wires, and output means coupled to its signal wires for transmitting instrument output signals as either an analog 4–20 mA signalling current or as a digital signal in a predetermined format.

In a particularly preferred embodiment of the invention, an intelligent instrument is provided by use of a computer which controls both the error compensation and the input/output signalling of the instrument.

Other objects and features of the invention will be understood with reference to the following specification and claims and the drawings.

DETAILED DESCRIPTION

Figure 1:
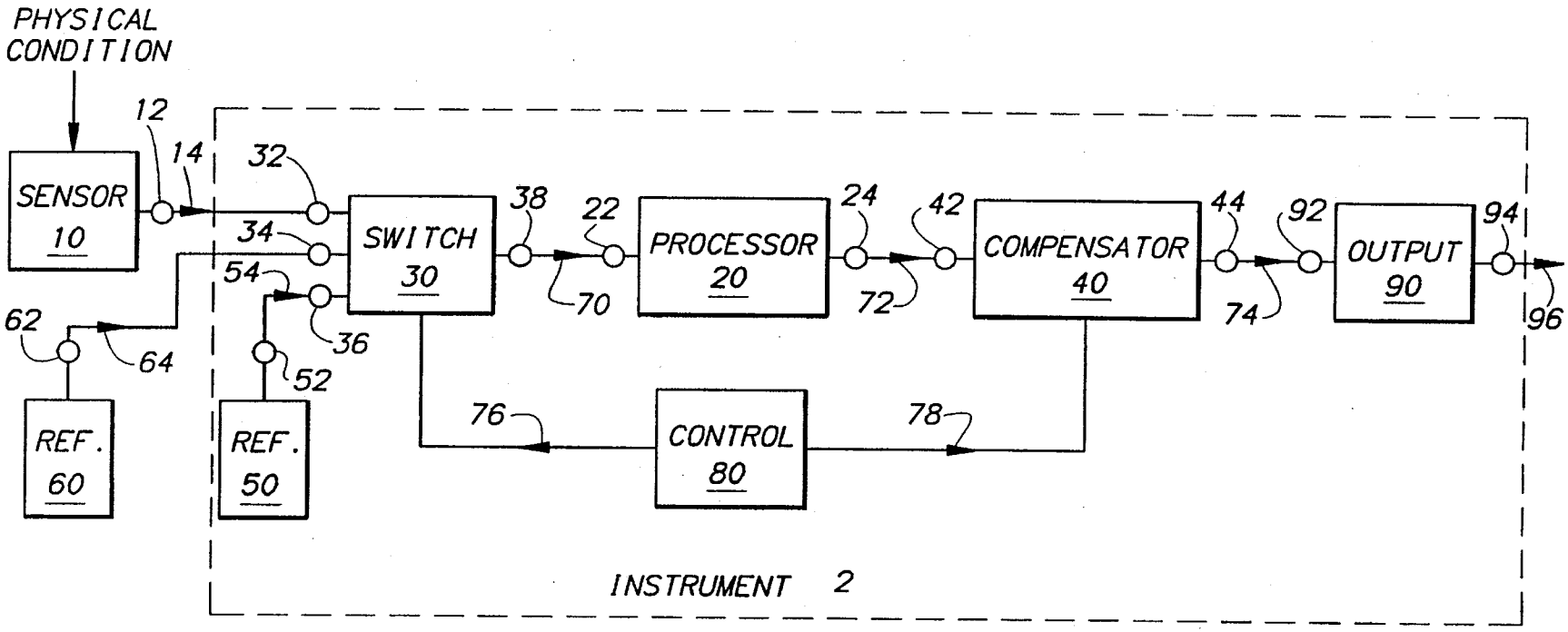
FIG. 1 is a block diagram illustrating the general features of an error compensating system according to the invention.

FIG. 1 is a block diagram illustrating the general features the error compensating system of the present invention. A sensor 10 provides an electrical sensor output signal 14 at sensor output terminal 12 which is a function of some physical condition to which the sensor responds. The sensor output signal 14 is supplied to an instrument 2 which includes a signal processing circuit or "processor" 20, a switch 30, a compensated signal generator or "compensator" 40, a control circuit 80. Processor 20 produces an output signal 72 at processor output 24 which is a function of the electrical signal 70 received at the processor input 22. A switch 30 selectively couples switch input signals received at switch inputs 32, 34, and 36 to switch output 38. One switch input (32) is coupled to the output 12 of sensor 10 so as to receive the sensor output signal 14 therefrom. Switch 30 includes at least one other input for receiving a reference signal from a reference source; FIG. 1 illustrates two additional switch inputs 34 and 36 to show that the reference sources may be either internal to the instrument 2 (reference 50) or external to the instrument (reference 60), or both. For instance, reference 60 may be an additional sensor which provides reference signals relating to the measurement itself, such as an additional admittance sensor providing an output which responds only to material electrical properties. Reference 60 provides a reference signal 64 at reference output 62 which is coupled to switch input 34, and reference 50 provides a reference signal 54 at reference output 52 which is coupled to switch input 36.

Switch 30 may operate in a number of modes, depending on the nature of the reference signals supplied and the error compensation to be provided based on the reference signals. Switch 30 may couple a selected one of the input signals to the switch output 38, or may couple combinations of one or more selected switch input signals to the switch output 38. Switch 30 may be embodied as a mechanical or electromechanical switch, or as an electronic switch which is generally preferable in low power applications such as two wire instruments.

Switch 30 operates under control of a control 80 which provides control signals 76 to switch 30 specifying the switch input signal(s) to be coupled to the switch output 38. The signal 70 which is provided as an output signal of switch 30 is coupled to input 22 of processor 20 as a processor input signal, and processor 20 produces an output signal 72 at processor output 24 in response to the particular processor input signal provided. Processor 20 may include conventional signal processing functions such as amplification, detection, and analog to digital conversion.

In principle, the signal processing of processor 20 can never be error-free; that is, the transfer function of processor 20 defining the actual relationship between output signal 72 and input signal 70 will never be exactly the same as the nominal, theoretical, or desired transfer function. While in the past efforts to minimize instrument errors have involved designing particular processors so that when they are built and operated their transfer functions will closely follow an intended or nominal transfer function, the system of FIG. 1 substantially reduces the need to do so while still providing a highly accurate instrument output. By appropriate selection of reference inputs, processed through the same processor 20 as the sensor signal 14 is processed, the processed sensor signal can be compensated by the processed reference signal(s) to provide a substantially error-free instrument output. Thus, a compensator 40 receives, as a compensator input signal at compensator input 42, the signal 72 output by the processor 20. Compensator 40 operates under control of a control signal 78 provided by control 80 so that the value of signal 72 at a particular time can be associated with a particular condition of switch 30, which is also controlled by control 80. Thus, compensator 40 acquires and stores the processor output 72 occurring when the sensor signal 14 is input to the processor 20, and acquires and stores the processor output 72 occurring when a reference signal 54 or 64 is input to the processor 20. Since both the sensor and the reference signals are processed by the same processor, errors in the transfer function of the processor will be reflected in the processor outputs due to each of these signals. Compensator 40 provides an output signal 74 at compensator output 44 which is a function of both the processed sensor and processed reference signals, the function being selected to minimize errors so as to provide a compensated output signal 74. The compensated signal 74 may be supplied to the input 92 of an output circuit 90 which generates an instrument output signal 96 at output 90 in a predetermined format based upon the value of the compensated signal 74.

Compensator 40 may be embodied by analog circuitry, such as sample/hold circuits for the signal storage function and analog amplifiers, multipliers, dividers, summing circuits, and the like for the mathematical compensating operations to be performed on the stored signals. It is believed to be generally more preferable to embody compensator 40 by digital circuitry, particularly microprocessor-based circuitry, since versatile and highly accurate compensation can be performed using relatively inexpensive and low-power digital circuitry. Moreover, control circuit 80 may easily be incorporated within such a microprocessor-based compensator.

In admittance-based material level monitoring instruments, one preferred mode of compensation as has been described is to provide a sensor which is responsive only to material electrical properties rather than material level.

Another preferred mode of compensation includes providing a reference 50 which provides a true zero input signal 54. The processor output signal 72 produced in response to such zero input is an offset or "zero" error, and that error signal can be subtracted by compensator 40 from the sensor-responsive processor output signal 72, to provide an instrument output 74 which is compensated for this zero error.

Another preferred compensation mode includes providing a reference 50 which generates a known and highly accurate nonzero signal. 54. This signal 54 may be processed by itself, in which case the processor output signal 72 may be used to compute the actual transfer function of processor 20, and compensator 40 may generate a compensated output signal representing the sensor signal based on the actual transfer function. Alternatively, the known reference signal 54 may be added to the sensor signal 14 and then processed, in which case the change in processor output 72 may be used to compute the incremental transfer function at the present operating point of the instrument, and the sensor-responsive processor output signal may be accordingly compensated. In either event, the reference signal processing in this mode serves to compensate the instrument for gain or "span" errors. For increased precision of compensation, a plurality of references 50 each providing a different known nonzero reference signal 54 may be provided (or equivalently a single reference producing a set of different known nonzero reference signals) so that gain errors may be compensated throughout the measuring range of the instrument. This permits compensation e.g. for nonlinearity of gain errors.

Figure 9:
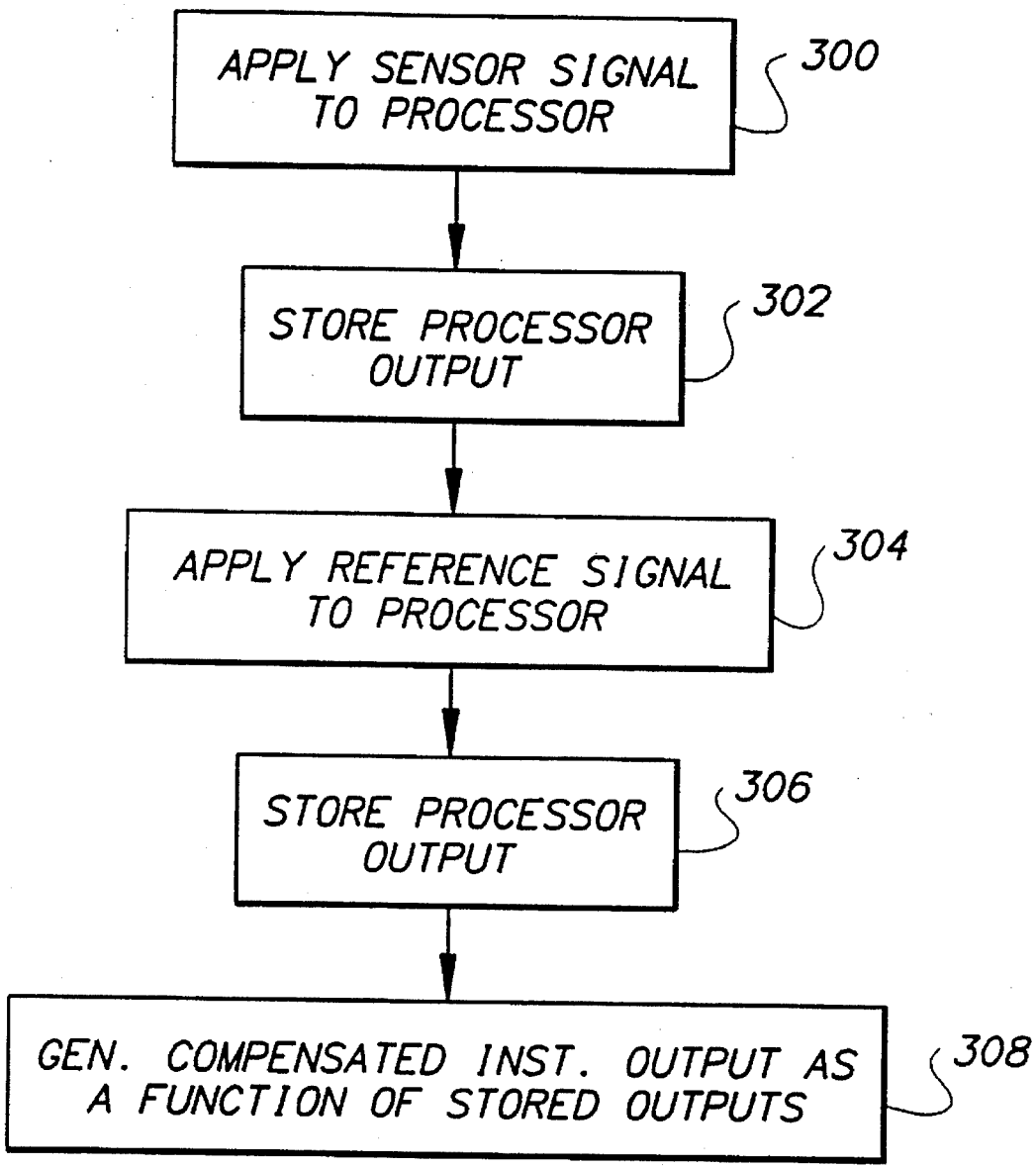
FIG. 9 is a flow diagram illustrating a method of operation which may be employed by the system of FIG. 1.

FIG. 9 is a flow diagram illustrating a method of operation of the system shown in FIG. 1. In step 300, the sensor signal 14 is applied to the processor 20 by switch 30. In step 302, compensator 30 stores the processor output 72 which is responsive to the sensor signal. In step 304, a reference signal such as signal 64 or 54 is applied to processor 20 by switch 30. In step 306, compensator 40 stores the processor output 72 which is responsive to the applied reference input. As indicated by the dotted path, steps 304 and 306 may be performed for each of the reference signals utilized by the system. In step 308, the compensated instrument output is generated as a function of the processor outputs which were stored in steps 302 and 306. Such a compensated instrument output 96 may be generated in one of a number of predetermined formats by output circuit 90 in response to compensated signals 74 generated by compensator 40 as a function of the stored processor outputs.

Figure 2A:
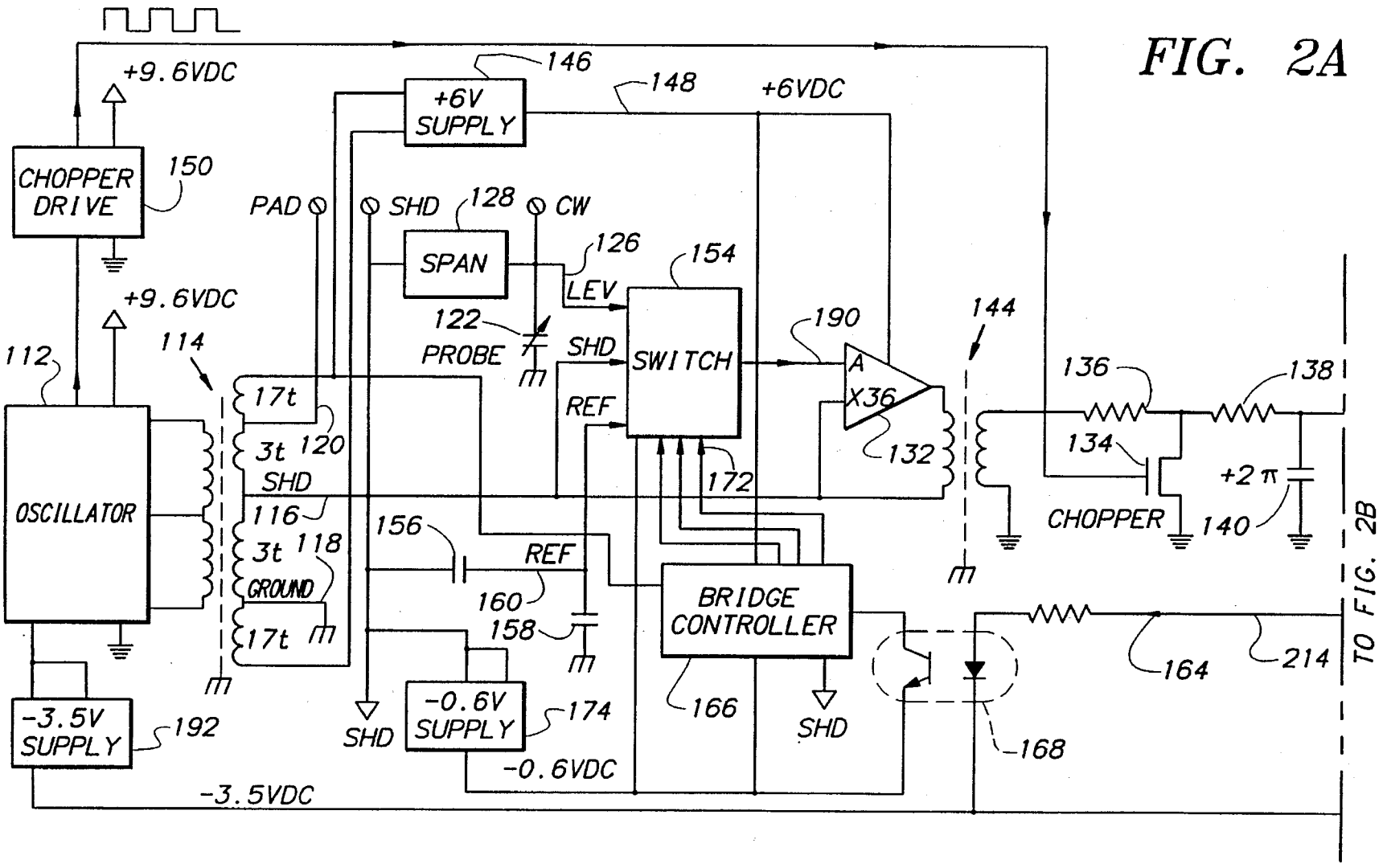
FIG. 2 is a block diagram illustrating a two-wire admittance responsive instrument system providing error compensation and input/output signalling capabilities in accordance with the invention.
Figure 2B:
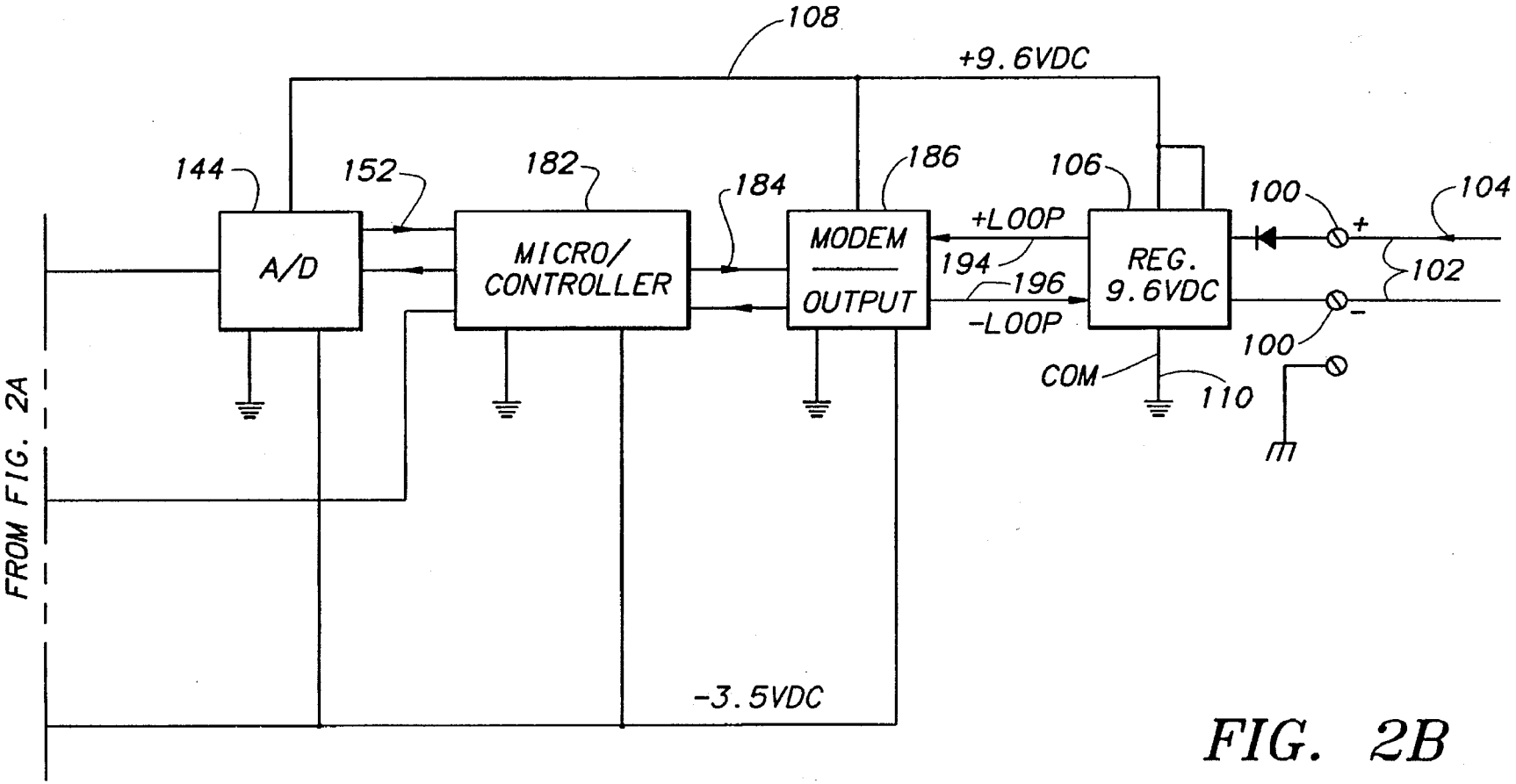

FIG. 2 is a block diagram illustrating the functional features of an error-compensating, two wire, radio frequency, admittance responsive instrument in accordance with the invention. Many of the functional blocks can be implemented by conventional circuits.

The instrument of FIG. 2 includes a pair of terminals 100 adapted to be coupled to a pair of conductors 102 which both supply operating power to the instrument and transmit the instrument output signal 104 to a remote location. The conductors 102 may be part of a conventional 4–20 mA signal loop. A regulator 106 is coupled to terminals 100 and provides a regulated output voltage, indicated as +9.6 VDC, to a conductor 108 with respect to a common potential 110. Regulator 106 supplies operating power either directly or indirectly to the remaining circuit blocks.

An oscillator 112 generates an A.C. signal, such as a 100 kHz radio frequency signal, which is coupled to the primary winding of transformer 114. The secondary of transformer 114 is a part of a transformer coupled admittance bridge. A fixed side of the bride is comprised of the three turn ("3t") between the shield (abbreviated "SHD") conductor 116 and the GROUND conductor 118. For isolation of the probe 122 from possible intrusion of hazardous potentials, the GROUND potential in the bridge-related circuitry is separate and isolated from the ground potential in the other circuitry. The variable side of the bridge includes probe 122, which corresponds to the sensor 10 of FIG. 1, and is depicted as a variable capacitance such as may be produced by a conventional capacitive level probe disposed in a vessel which contains material. The material responsive admittance of probe 122, or the radio frequency current through or voltage across it, may be considered the sensor output signal 14 of FIG. 1. The variable side of the bridge also includes a span element 128, which may be a capacitance. The admittance of span element 128 and the admittance of probe 122 form a divider across the shield-to-ground voltage, having a divider ratio which is a function of the variable probe admittance and produces the variable bridge output signal LEV at conductor 126. That function may be stabilized and linearized by selecting a span admittance 128 which is large compared to the maximum admittance of probe 122. A cost or detriment of doing so is that the bridge output signal LEV is a very small radio frequency signal which requires processing to provide useful instrument output signals.

The primary signal processing is performed by a processor circuit block which includes an amplifier 132; a chopper or phase-sensitive detector comprising chopper transistor 134, resistors 136 and 138, and capacitor 140; and an analog to digital (A/D) converter 144. Amplifier 132 is powered by a supply 146 which generates a D.C. voltage (indicated as +6 VDC) with respect to the shield potential by rectifying and filtering voltages generated by the secondary of transformer 114. The output of amplifier 132, a shield-referenced radio frequency signal, is converted to a power supply common-referenced signal at the secondary of transformer 144, which signal is synchronously detected by the chopper. The gate of chopper transistor 134 is driven by a chopper drive 150, which produces a square wake drive signal having a predetermined phase relationship to the oscillator 112 (and therefore also to the bridge). The output of the chopper, at conductor 142, is a D.C. signal having an amplitude which is a function of the amplitude of the amplifier output signal and the phase of the amplifier output signal with respect to the bridge. In order to permit use of digital circuitry to effect error compensation, the analog D.C. chopper output signal at 142 is supplied to A/D converter 144 which digitizes the signal and outputs the digitized signal at 152.

Amplifier 132 has one input connected to the shield potential SHD, which is the generally fixed reference potential for the bridge signals. The other input to amplifier 132 is connected to the output of switch 154, which corresponds to switch 30 of FIG. 1. Switch 154 selectively couples one or more of its three input signals LEV, SHD, and REF to the switch output and thus to the input of amplifier 132 for processing. As has been described, the LEV signal is the sensor-derived variable bridge signal which may represent a material level, and the shield potential SHD is the reference potential of the fixed side of the bridge and represents an internal zero reference signal. In accordance with the preferred embodiment of invention, another reference signal REF is also coupled to an input of switch 154, corresponding to another internal reference signal 54 of FIG. 1. The REF signal is generated at conductor 160 by capacitors 156 and 158 forming a divider across the shield-to-ground signal. The reference signal REF is a nonzero signal and is desirably chosen to correspond to a LEV signal which would be provided under certain operating conditions within the measuring range of the instrument, e.g. a specified percentage of full scale. The reference signal REF may be designed to be substantially fixed. However, it may be highly desirable for the reference signal to vary in a known fashion. For instance, capacitors which in practice are suitable for the span element 128 may have a nonzero nominal temperature coefficient (e.g. polypropylene capacitors) which would introduce a change in the LEV signal as a function of instrument temperature. Provision for compensation of this type of effect can be made by making the REF signal vary in the same manner as the LEV signal. Accordingly, for example, capacitor 156 can be implemented using a component of the same type or otherwise having the same temperature coefficient as span element 128, and capacitor 158 can be a stable type such as a COG type capacitor to match the temperature coefficient of a stable admittance probe.

The particular input(s) to be coupled to amplifier 132 are selected by switch 154 in response to a control signal 172 presented on three control signal lines and generated by bridge controller 166, which is powered by the shield-referenced supplies 146 and 174. Supplies 146 and 174 are derived and powered from the bridge-energizing secondary winding of transformer 114, to provide isolated power supplies for bridge-related circuitry including switch 154, amplifier 132, and bridge controller 166. Bridge controller 166 generates the shield-referenced control signal 172 in response to a power supply common-referenced control signal 164 supplied by microcontroller 182. Optoisolator 168 interfaces the ground-referenced signal 164 to the shield-referenced bridge controller 166.

The digitized signal 152 is supplied to microcontroller 182, which provides various compensation as well as control functions. Microcontroller 182 is desirably implemented using an integrated circuit such as a type 68HC705C9 microprocessor operating under control of programs stored in associated memory. Microcontroller 182 stores signals 152 obtained at times when it has controlled the switch 154 to select the LEV, SHD, and REF signals for processing. In accordance with a particularly preferred embodiment of the invention, the signals 152 are compensated as follows. The LEV and REF signals are each compensated for zero errors by subtracting from them the signal present when the true-zero input SHD is processed. Gain errors are compensated by dividing the compensated LEV signal by the compensated REF signal. Thus, the output of microcontroller 182 is a signal which is the following function of the responses to the various selected input signals:

$$OUTPUT=K\cdot(LEV-SHD)/(REF-SHD),$$

where K is an arbitrary scale factor. Microcontroller 182 is coupled to a modem/output circuit 186 which comprises both an input circuit for receiving digital control signals from signal wires 102 and an output circuit for supplying instrument output signals to signal wires 102. Preferably modem/output 186 is capable of generating either an analog signalling current in signal wires 102 or a digital signal in signal wires 102. Preferably, the type of instrument output signal is selected by microcontroller 182 in accordance with signals received over signal wires 102 instructing the instrument as to the type of output signal to be provided.

Isolation of the probe-related circuitry is provided by transformers 114 and 144 and optoisolator 168. While intrinsic safety standards generally require about 2500 VRMS isolation capability for such isolating components, applicant prefers to use components having a breakdown voltage at or above about 4000 VRMS. Such isolation can be provided by judicious design of transformers 114 and 144 and by use of an optoisolator such as a type CNY65EXI.

FIGS. 3–8 are schematic diagrams of preferred circuits for certain of the circuit blocks shown in FIG. 2. It is believed that circuits for other circuit blocks can be generated by those skilled in the art without undue experimentation.

Figure 3:
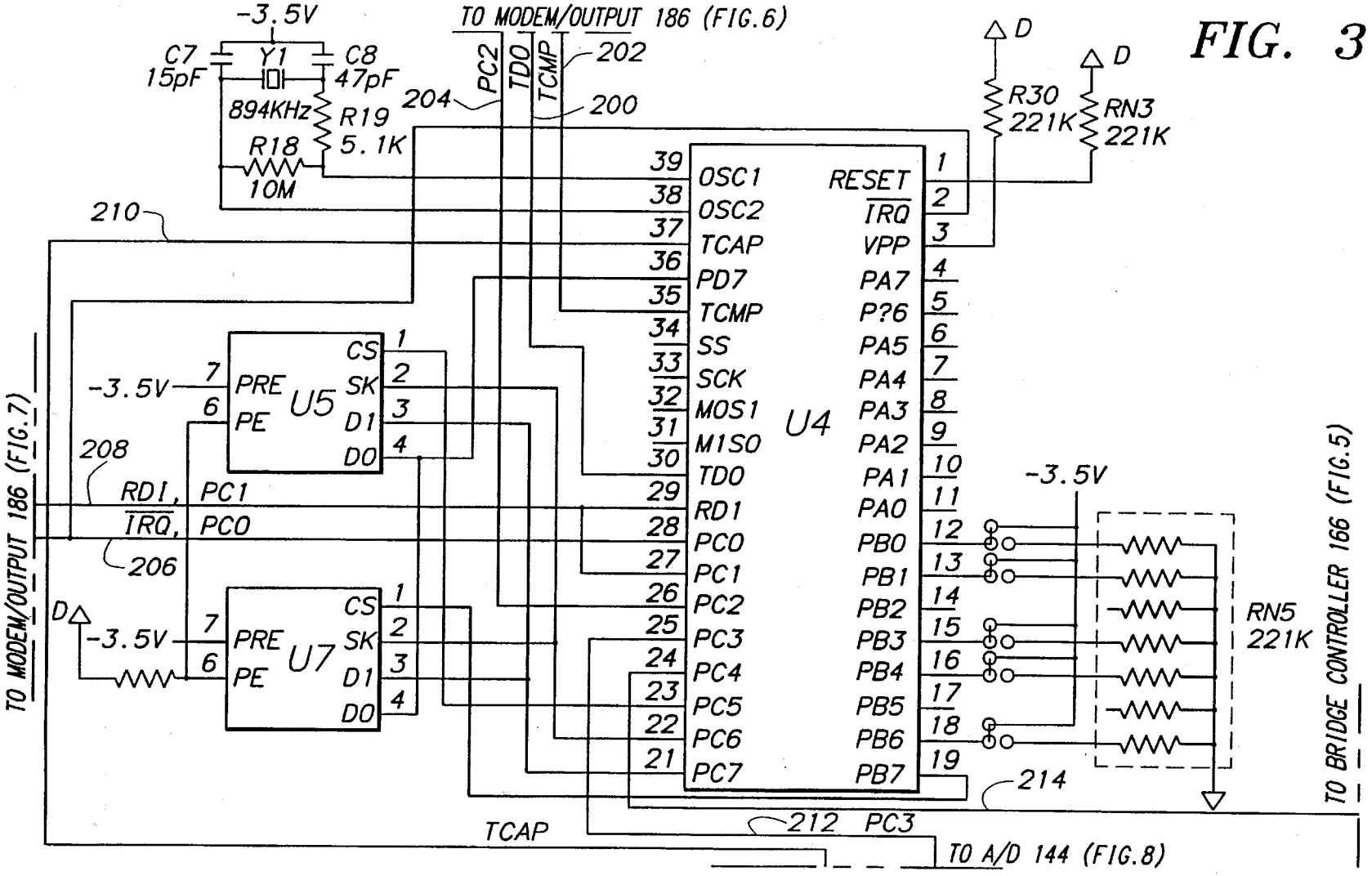
FIG. 3 is a schematic diagram of a preferred microcontroller circuit for use in the system of FIG. 2.

FIG. 3 is a schematic diagram of preferred circuitry for use in microcontroller 182. The circuit is based on microprocessor U4, a type 68HC705C9 microprocessor. This processor is highly desirable for use in such a two wire instrument because it is fully static and can operate at voltages as low as 3.5 V. Operating at such a low voltage substantially reduces the power consumption of the microprocessor, which is of substantial concern in low power instruments such as the present. The power supply for microprocessor U4 is shown in block form in FIG. 2 as −3.5 V supply 192. This supply is created by rectifying a potential generated by oscillator transformer 114, whereby the oscillator acts as a DC—DC converter operating at high efficiency. If microprocessor U4 were powered by a linear regulator, substantial power would be wasted in the regulator. Clock signals for microprocessor U4 are generated by a conventional crystal oscillator circuit including crystal Y1. The preferred microprocessor has 16 kB of PROM space for storage of operating programs, and 352 bytes of RAM space. EEPROMs U5 and U7, type NM93CS66, are provided for storage of parameters to configure a particular instrument.

Figure 5:
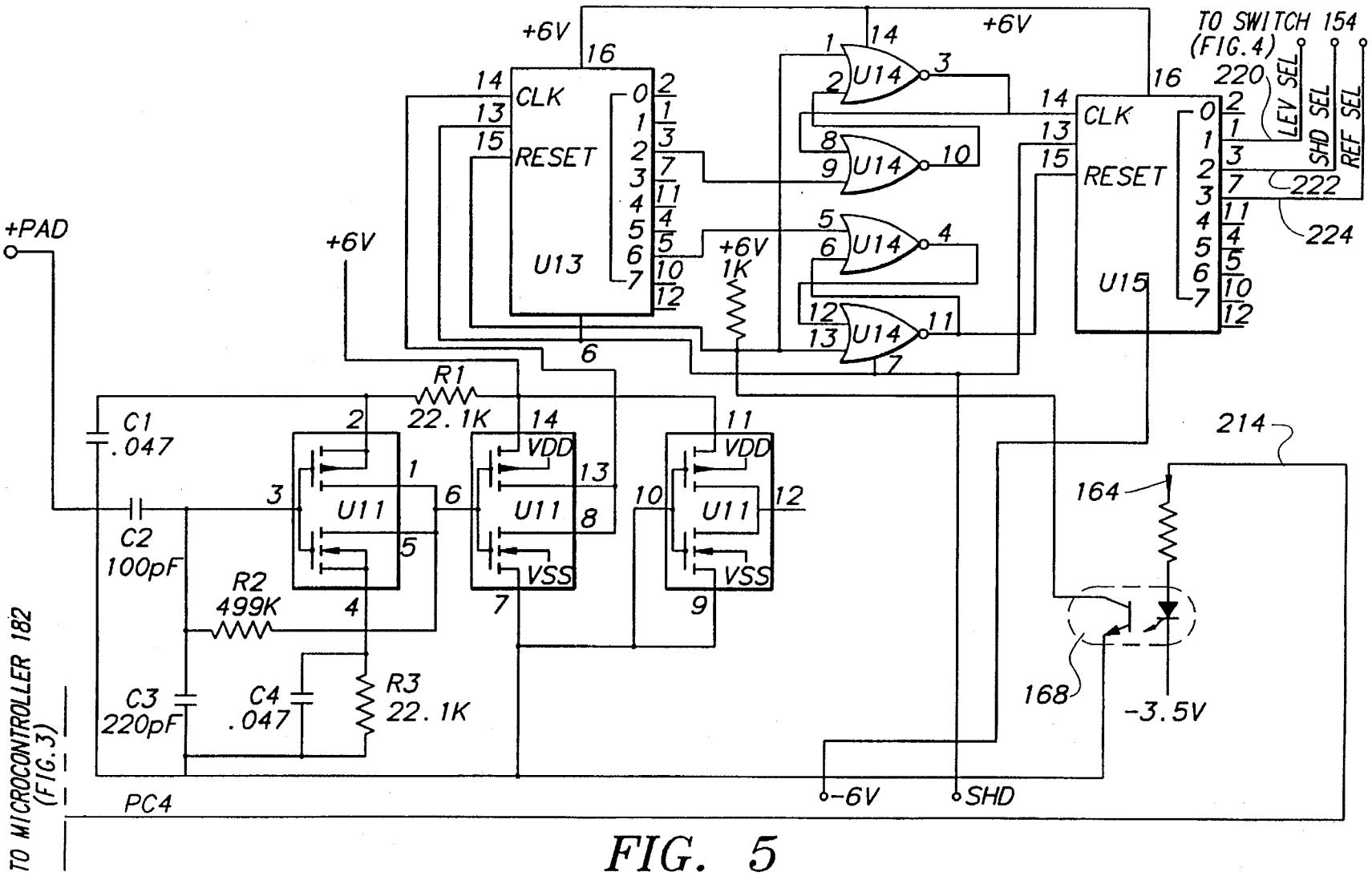
FIG. 5 is a schematic diagram of a preferred bridge controller circuit for use in the system of FIG. 2.
Figure 6:
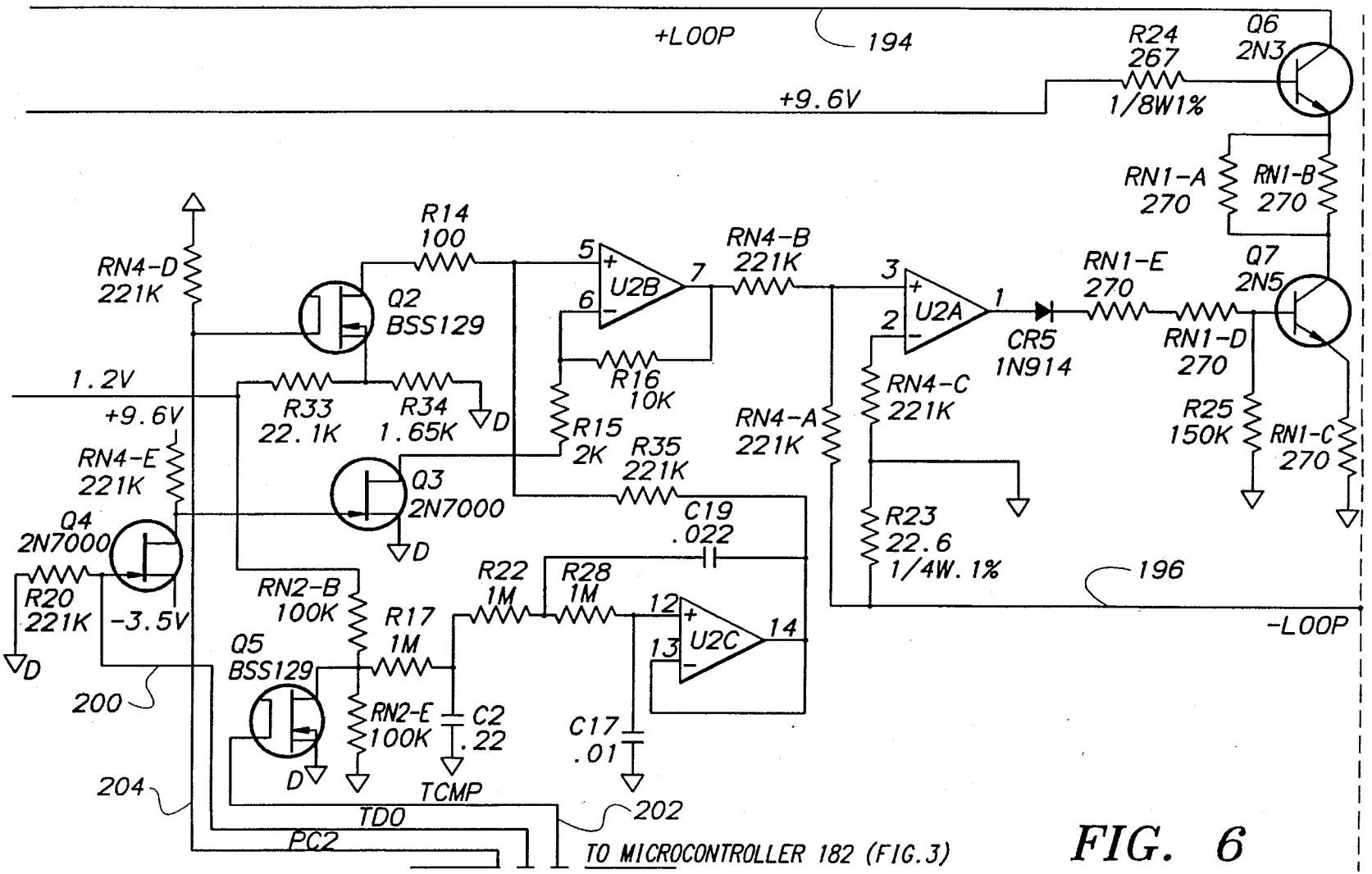
FIG. 6 is a schematic diagram of a preferred modem/output for use in the system of FIG. 2.

Microprocessor U4 is coupled to the modem/output circuit 186 by three lines 200, 202, 204 which control the analog and digital signals output by the instrument as described with respect to FIG. 6. Microprocessor U4 is coupled by a pair of lines 206, 208 to an input pulse recognition circuit comprising modem/output 186 for receiving digital signals from the signal wires, as described with respect to FIG. 7. Microprocessor U4 is coupled by a pair of lines 210, 212 to A/D converter 144, as described with respect to FIG. 8. Finally, microprocessor U4 supplies an output signal on line 214 for controlling the operation of the bridge controller 166 (and thus the switch 154) as described with respect to FIG. 5.

Figure 4:
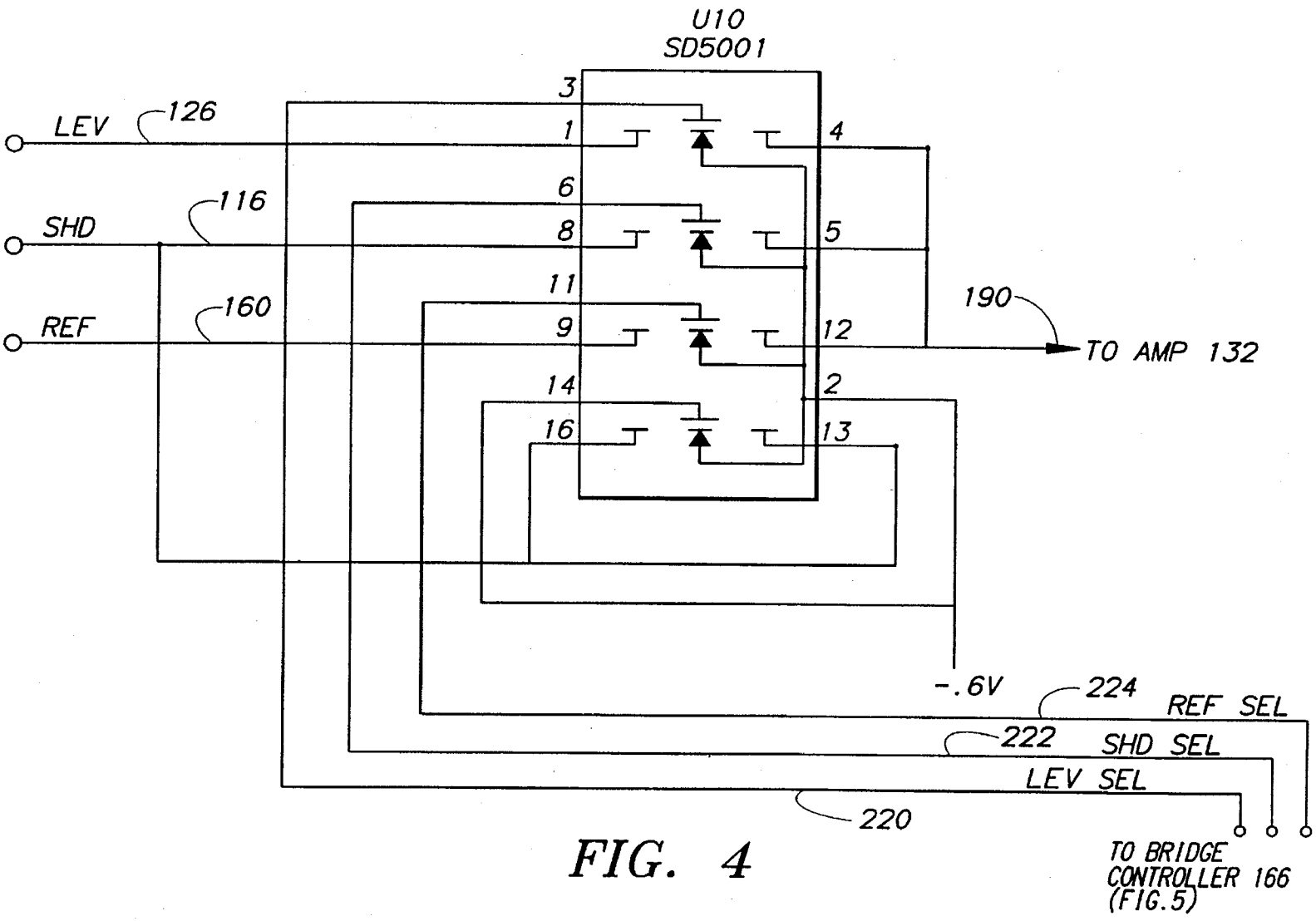
FIG. 4 is a schemetic diagram of a preferred bridge switch for use in the system of FIG. 2.

FIG. 4 is a schematic diagram of a preferred switch circuit 154. The circuit includes three field effect transistors which are operated as analog switches. As shown, these switches are included in a type SD5001 integrated circuit, utilizing three of the four transistors provided. The sources of the active transistors are connected together and provide the switch output 190, which is coupled to an input of amplifier 132. A high signal on the switch selecting lines LEV SEL, SHD SEL, and REF SEL turns on the selected transistor and couples the bridge signals LEV, SHD, and REF, respectively, to the switch output.

FIG. 5 is a schematic diagram illustrating a preferred circuit for use as bridge controller 166 shown in FIG. 2. For clarity of description, also shown in FIG. 2 are the optoisolator 168 and control line 214 carrying control signal 164 from microcontroller 182. The circuit of FIG. 5 receives a switch control signal 164 on a single ground-referenced conductor 214 and from that signal generates switch control signals LEV SEL, SHD SEL, and REF SEL which place the switch 154 in a selected one of three conditions. Although an equivalent switch-selecting function could be obtained using a simpler bridge controller having three optoisolators 168 each receiving a control signal from the microprocessor and providing a control signal to the switch, applicant prefers to control the switch state by a single switch-controlling signal from the microprocessor, for several reasons. Optical isolators which are suitable for use in the application, to provide the isolation required for intrinsic safety, are both large and expensive. Also, the number of control lines available from a microprocessor may be limited.

The bridge controller of FIG. 5 responds to control input pulses 164, the width of which determines the function performed and state assumed by the bridge controller. A clock signal is provided by U11, which may be a CD4007 integrated circuit. Two of the inverters of this circuit are used to amplify the bridge signal indicated as PAD and thereby provide a square wave at the oscillator frequency. For an oscillator operating at 100 kHz, this provides a square wave having a 10 microsecond period. These clock pulses are supplied to the CLK input of U13, a type CD4022 decoded octal counter. In the absence of a control pulse 164 from the microcontroller, the RESET input of U13 is maintained high. When a control pulse 164 from the microcontroller is commenced, the phototransistor of optoisolator 168 turns on and pulls the RESET input of U13 low, and U13 commences counting pulses from the clock. Decoded outputs from U13 are supplied to a pair of flip-flops comprising U14, a type CD4001 integrated circuit, and the flip-flop outputs are supplied to the CLK and RESET inputs of U15, another type CD4022 decoded octal counter. Decoded outputs of counter U15 provide the LEV SEL, SHD SEL, and REF SEL output signals to the switch 154.

Operation of the counting circuitry is as follows. The state of U15 may be set to a known condition by resetting it. A control input pulse 164 from the microcontroller which is of long enough duration to permit U13 to count to its "6" output will toggle the associated flip-flop and reset U15. With a ten microsecond clock period supplied to U13, a microcontroller control pulse longer than about 60 microseconds is required, it being understood that the microcontroller's internal clock and the clock which is counted by U13 are asynchronous. From this initial reset state, U15 may be placed into other desired states by applying successive clock pulses to it. This occurs when the microcontroller outputs a control signal 164 having a width which is long enough to reach or exceed the "2" count of U13 but not long enough to reach the 6 count of U13, the latter of which would result in another reset. Thus, a microcontroller pulse 164 of about 40 microseconds duration will cause U13 to pass the 2 count, which toggles the associated flip-flop and supplies a clock input to the CLK input of U15. This advances the count of U15, thereby bringing it to the next successive state ("1" output high). U15 can be further advanced to successive states by supplying additional control signals having a duration intermediate the 2 and 6 counts of U13. Thus, two different signals 164 are supplied to the bridge controller 166 to control its state, a relatively short pulse and a relatively long pulse. These two signals allow the bridge controller 166 to assume any available state, a long pulse resetting the circuit to a known state and short pulses successively incrementing the state of the bridge controller. With the switch controlling outputs as shown in FIG. 5, a long microcontroller pulse will reset U15 into a nonactive state. A first narrow pulse will cause line 220 to go high and the LEV input to the switch to be selected, a second narrow pulse will cause line 222 to go high and the SHD input to the switch to be selected, and a third narrow pulse will cause line 224 to go high and the REF to the switch to be selected.

FIG. 6 is a schematic diagram of a preferred modem/output circuit 186. The modem/output circuit receives compensated signals from the microcontroller and generates current signals in the signal wires 102 which are responsive to the compensated signal. In accordance with the invention the modem/output circuit can generate both an analog current output signal which is proportional to the compensated signal, and a digital current output signal representing the compensated signal in a predetermined digital format. The type of output signal is selected by the microcontroller 182, preferably in accordance with digital signals received by the instrument from the signal wires.

The digital signals which are generated by modem/output circuit 184 may be in any predetermined format which is operable in a two wire loop, whether now existing or hereafter developed. The particular circuit shown in FIG. 6 is designed to produce digital signals in a standard format originated by Honeywell, which signals are square wave current signals in which the current is alternated between 4 mA and 20 mA. Another useful digital signal format is the Hart protocol in which the frequency of a sinusoidal current superimposed on the signal wires 102 is alternated between 1200 Hz and 2200 Hz.

The modem/output circuit includes a feedback current-controlling circuit which is based upon amplifier U2A, transistors Q6 and Q7, and associated passive components. All current flowing in the signal wires 102, except for a small amount passing through feedback resistor RN4-A, must flow through sensing resistor R23, which develops a voltage across it (between the regulator common potential and the negative signal wire –LOOP). U2A provides feedback control of the current flowing through sensing resistor R23 by controlling the current flow through transistors Q7 and Q6, Which must pass through the sensing resistor. The total instrument current is feedback controlled via resistors RN4-B and RN4-A, forming a 1:1 voltage divider, at a level such that the voltage across sensor resistor R23 is equal to the output voltage of amplifier U2B with respect to common, at which point the inputs of amplifier U2A are equal.

Amplifier U2B is operable in two modes, one as a unity gain buffer and one as an amplifier with a gain of five, under control of signals Output from the TDO pin of microprocessor U4 on line 20. In providing an analog current output signal, in the manner to be described, a high signal on line 200 turns transistor Q4 on, thereby turning transistor Q3 off and rendering the feedback of U2B solely through R16, whereby it operates as a unity gain buffer.

The compensated signal output of microprocessor U4 is a pulse width modulated signal at pin TCMP, which is applied on line 202 to the gate of transistor Q5. A stable 1.2 V supply potential from regulator 106 is supplied to a 1:1 voltage divider comprising resistors RN2-B and RN2-E. The drain of transistor Q5 is coupled to the tap of this voltage divider, so that the pulse width modulated gate signal alternately provides a short circuit and an open circuit across resistor RN2-E. The pulse width modulated signal at the drain of Q5 is supplied to a passive lowh pass filter comprising R17 and C2, and an active low pass filter comprising U2C, R22, R28, C19 and C17. The output of amplifier U2C is a DC signal having an amplitude varying from 0 to 0.6 V proportional to the duty factor of the pulse width modulated signal at TCMP, and is supplied to the positive input of amplifier U2B to generate the analog current controlling output voltage of U2B.

For digital communications in the Honeywell protocol, microprocessor U4 provides a high signal at port PC2 which is connected by line 204 to the gate of transistor Q2, which turns on Q2 and applies the potential generated by resistive divider R33, R34 through resistor R14 to the positive input of U2B. R35 effectively isolates the output of U2C in this condition. The divider ratio of R33, R34 is selected to apply a potential to the positive input of amplifier U2 which will generate a 4 mA loop current. Microprocessor U4 then applies an output signal on line 200 to the gate of transistor Q4, which turns it on and off at the serial communications rate and changes the gain of amplifier U2B from one to five at the serial communication rate of the Honeywell protocol. Such a gain change results in the instrument output current alternating between 4 mA and 20 mA at the serial communications rate of the Honeywell protocol.

Figure 7:
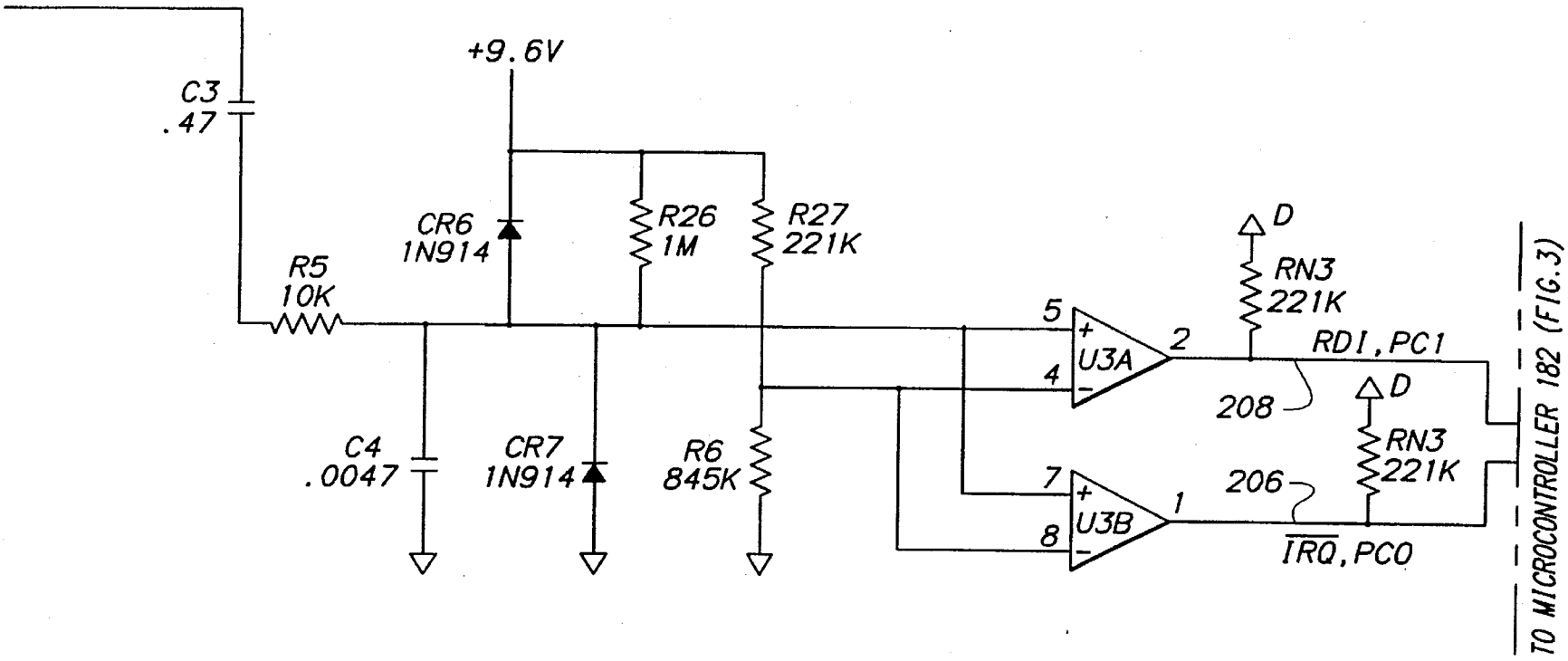
FIG. 7 is a schematic diagram of a preferred digital input signal recognition circuit for use in the system of FIG. 3.

FIG. 7 is a schematic diagram of a preferred circuit for receiving digital input signals from signal wires 102 in the Honeywell protocol and supplying them to microprocessor U4 in the appropriate format. In the Honeywell protocol, digital signals are supplied to a two wire instrument as voltage changes of 4 V or more in the signal wires. Such voltage signal are coupled from the +LOOP signal wire conductor through decoupling capacitor C3 to pulse recognition circuitry based upon a pair of comparators U3A and U3B, comprising a type TLC339 integrated circuit. The negative inputs of these comparators are coupled to a voltage of about 8 V generated by a resistive divider comprising R27 and R6. Under normal operating condition, the positive inputs of these comparators will be held high by resistor R26 coupled to the +9.6 V supply, forcing the comparator outputs low. In the Honeywell protocol, a controlling device coupled to the signal wires sends a "wake-up pulse" in the form of a sudden 4 V drop in the loop voltage for a fixed period of time, followed by serial data in the form of further voltage changes. C3, R5, C4, and R26 form a band pass filter which passes the sudden changes in the loop voltage which represents signals to the comparator inputs but rejects slowly varying loop voltages and high frequency noise. The occurrence of a wake-up pulse on the signal wires drives the positive comparator inputs low, whereby U3B generates an interrupt request which is presented on line 200 to the IRQ input of microprocessor U4. Upon receipt of an interrupt, microprocessor U4 disables the IRQ input by a signal provided at port PCO, so that following data does not further interrupt the microprocessor. Microprocessor U4 causes the output/modem circuit 186 to generate an instrument current of 4 mA. Data following a wake-up pulse is output by U3A on line 208 as a square wave signal which is applied to the serial read input RDI and port pin PCl of microprocessor U4, and is read into the microprocessor's buffers.

Figure 8:
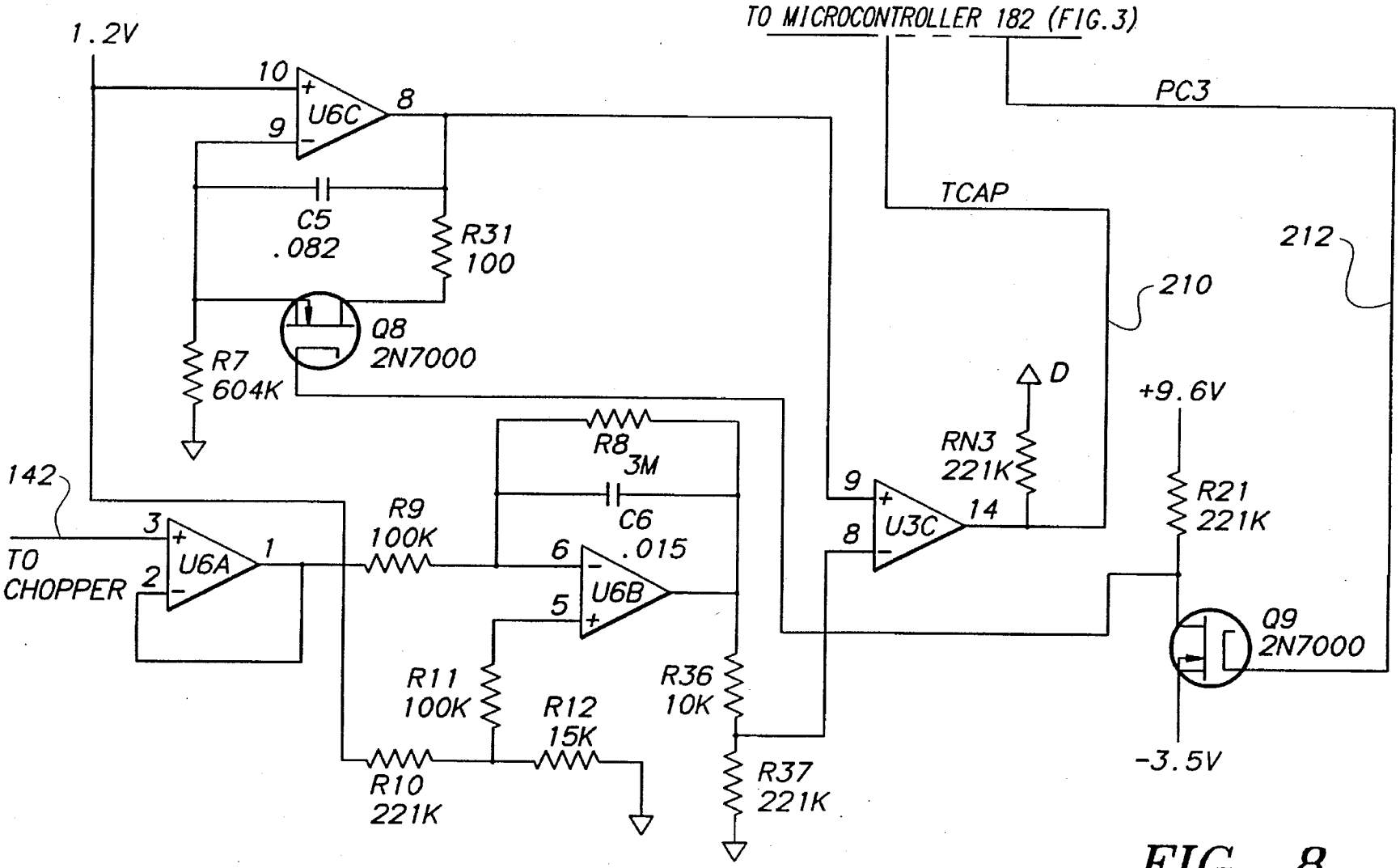
FIG. 8 is a schematic diagram of a preferred A/D circuit for use in the system of FIG. 2.

FIG. 8 is a schematic diagram of a preferred A/D converter circuit 144 which operates under the control of microcontroller 182. In this circuit, amplifier U6C functions as an integrator or ramp generator which operates under the control of transistor Q8. When Q8 is turned on, it shorts integrating capacitor C5 and the output of U6 is constant; when Q8 is turned off, integration begins and the output of U6 rises at a fixed rate. The output of U6 is coupled to the input of comparator U3C. The negative input to U3C is derived from the chopper output 142, which is buffered by amplifier U6A and amplified and supplied with a DC offset by amplifier U6B and its associated components.

A/D conversion takes place as follows. Prior to conversion, a signal from processor port PC3 on line 212 turns off transistor Q9 which turns on transistor Q8 to short the integrating capacitor C5. When a conversion is to take place, microprocessor U4 turns off the shorting transistor Q8 and reads an internal timer. The integrator begins to integrate and continues to do so until the integrating voltage at the output of U6C becomes greater than the chopper-derived voltage at the negative input of U3C, whereupon the output of comparator U3C on line 210 to the microprocessor U4 goes high. This captures the count of the internal timer, which when the initial count is subtracted represents a digital equivalent of the analog chopper output signal 142.

With A/D converter 144 as well as the switch 154 operating under control of the microprocessor, the microprocessor may select an appropriate input to the signal processing circuitry, allow time for the signal processing circuitry to stabilize, and then commence conversion.

Accordingly, the system shown in FIGS. 2–8 provides an intelligent instrument system in which a microcontroller controls the signal processing and input/output functions of the instrument to satisfy the objects of the invention. The system provides a radio frequency admittance monitoring instrument which provides highly accurate compensated instrument outputs in a variety of desirable formats, is operable under the low power constraints of two wire systems, and provides the high isolation required in many industrial applications for admittance monitoring.

Figure 10:
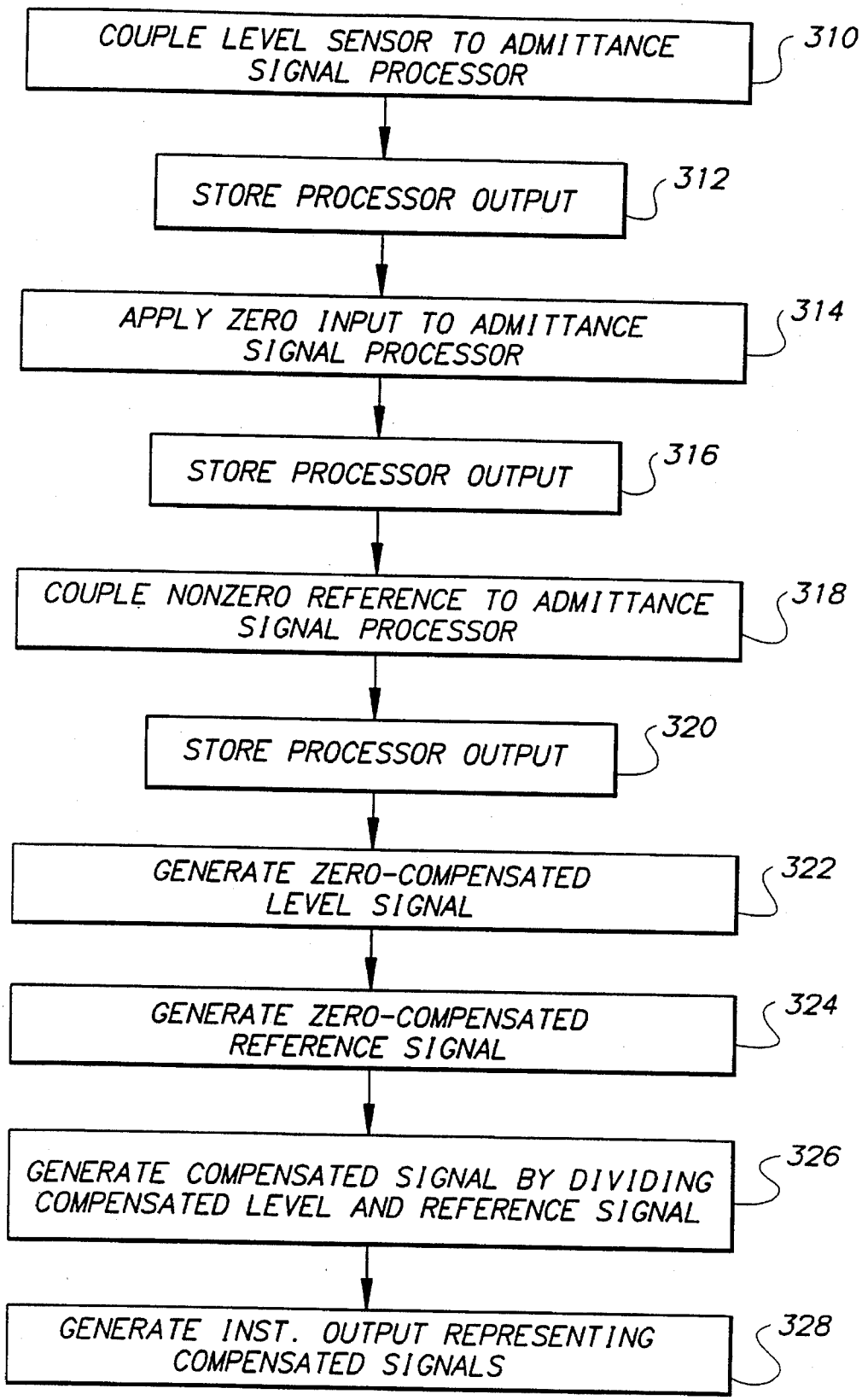
FIG. 10 is a flow diagram illustrating a method of operation which may be employed by the system of FIG. 2.

FIG. 10 is a flow diagram of a preferred method of operating the system of FIGS. 2–8, which is a specific example of the general method of instrument operation shown in FIG. 9. In step 310, the output LEV of the level sensor (probe 122) is coupled to the admittance signal processing circuitry (amplifier 132, chopper, and. A/D converter 144) by switch 154 under control of microcontroller 182. In step 312, the processor output from A/D converter 144 is stored in the microcontroller. In step 314, the SHD input is coupled to the admittance signal processing circuity, under control of microcontroller 182, to supply a true zero input as a reference. In step 316, the processor output corresponding to this reference is stored. In step 318, switch 154 couples the nonzero reference signal REF to the admittance signal processing circuitry under control of microcontroller 182, and in step 320 the processor output responsive to this reference input is stored in microcontroller 182. Steps 310–320 may be performed repetitively under control of a stored program in microcontroller 182, such as in the following manner. The LEV signal may be switched into the admittance signal processing circuitry, and after an appropriate instrument settling time a number of A/D conversions may be repetitively performed and the results stored. Microcontroller 182 may disregard A/D outputs which are apparently spurious because of deviations from expected conditions, and may average the valid A/D signals to provide an average level signal. A/D conversions may take place several times per second, and perhaps 100 converted signals may be obtained over a period on the order of 30 seconds and averaged. This period is sufficiently short that changes in the actual material level are unlikely to occur in the averaging period under most circumstances. Similar repetitive acquisition and processing may be performed for the reference signals in steps 314–320, although at the lower signal levels typically provided the conversion times are generally much shorter. In step 322, microcontroller 182 generates a zero-compensated level signal by subtracting the stored signal representing the response to the zero input SHD from the stored signal representing the response to the level input LEV. In step 324, by a similar process, microcontroller 182 generates a zero-compensated reference signal by subtracting the response to the zero input SHD from the response to the nonzero reference input REF. In step 326, microcontroller 182 generates a compensated signal by dividing the compensated level signal by the compensated reference signal. Steps 322–326 provide a compensated signal in accordance with the formula set forth above at page 18. In step 328, microcontroller 132 causes modem/output circuit 186 to generate a compensated instrument output in accordance with the compensated signal generated in step 326, in a predetermined instrument output format.

While certain preferred embodiments of the invention have been described herein, modifications and variations which do not depart from the spirit and scope of the invention will no doubt occur to those skilled in the art.

What is claimed is:

1. An error compensating two wire instrument system comprising:

means for receiving all instrument operating power from a pair of signal wires;

a reference source producing reference signals;

a sensor producing sensor signals which are responsive to physical conditions but are independent of said reference source and signals;

common signal processor means for alternately receiving and processing, in a common signal processing path said sensor signals to provide processed sensor signals and signals including said reference signals to provide processed reference signals;

means for compensating said processed sensor signals by said processed reference signals to produce compensated signals: and means for generating an instrument output signal in said signal wires in accordance with said compensated signals.

2. A system according to claim 1, wherein said compensating means includes means for alternately receiving and storing processed sensor signals and processed reference signals.

3. A system according to claim 1, wherein said reference source produces a reference signal representing a zero sensor signal, and said compensating means subtracts said processed reference signal from said processed sensor signal.

4. A system according to claim 1, wherein said reference source produces a reference signal representing a nonzero sensor signal, and said compensating means divides said processed sensor signal by said processed reference signal.

5. A system according to claim 1, wherein said system includes a plurality of reference sources each producing a reference signal.

6. A system according to claim 5, wherein said reference sources include a zero reference source producing a zero reference signal representing a zero sensor signal and a nonzero reference source producing a nonzero reference signal representing a nonzero sensor signal.

7. A system according to claim 1, wherein said reference source produces signals which are responsive to physical conditions to which said sensor signals are responsive.

8. A system according to claim 1, wherein said sensor is an admittance sensor and said signal processor means includes a radio frequency signal processor.

9. A system according to claim 1, wherein said instrument system is a two-wire instrument system in which said instrument output signal is a current in the range of about 4–20 mA.

10. A system according to claim 1, wherein said compensating means includes a microprocessor.

11. A system according to claim 1, further including switch means for selectively coupling said sensor signals and said reference signals to said signal processor means.

12. A method of error compensating an instrument system comprising the steps of:

receiving instrument operating power from a pair of signal wires;

at intervals, processing a sensor signal in a signal processing path comprising said instrument system;

processing a reference signal in said signal processing path at intervals alternately with the processing of said sensor signal; and generating a compensated output signal in said signal wires as a function of said processed sensor signal and said processed reference signal.

13. The method of claim 12, wherein said reference signal represents a zero sensor signal, and said function includes the difference between said processed sensor signal and said processed reference signal.

14. The method of claim 12, wherein said reference signal represents a nonzero sensor signal, and said function includes the ratio of said processed sensor signal and said processed reference signal.

15. A two wire radio frequency admittance responsive instrument system comprising:

means for receiving instrument operating power from a pair of signal wires;

sensor means for generating an admittance signal which is responsive to the condition of materials adjacent said sensor;

radio frequency signal processing means coupled to said sensor means for generating electrical signal s which are responsive to said sensor admittance signals;

input/output means for receiving digital input signals from the signal wires and for transmitting instrument output signals to the signal wires in either analog or digital form; and control means coupled to said signal processing means for receiving said electrical signals and coupled to said input/output means for controlling the receipt of said digital input signals and controlling the transmission of said instrument output signals in accordance with said electrical signals.

16. A system according to claim 15, wherein said control means includes a microprocessor operating under control of a stored program.

17. A system according to claim 15, wherein said digital form of said transmitted output signals is an alternating current in the signal wires.

18. A system according to claim 15, wherein said control means includes means for selecting the form of said output signals in accordance with received digital input signals.

19. A system according to claim 15, wherein said control means includes means for measuring and compensating said electrical signals for signal processing errors occurring in said signal processing means.

20. A system according to claim 19, wherein said compensating means includes means for measuring and compensating zero errors occurring in said signal processing means.

21. A system according to claim 19, wherein said compensating means includes means for measuring and compensating gain errors occurring in said signal processing means.

22. A system according to claim 19, further including reference signal means for generating reference signals and switch means for selectively coupling said sensor and said reference signal means to said signal processing means, wherein said compensating means includes means for controlling said switch means.

* * * * *